United States Patent [19]

Lovatt

[11] 4,141,681

[45] Feb. 27, 1979

[54] SUPPORT STRUCTURE FOR CERAMIC WARE

[75] Inventor: William J. Lovatt, Stoke on Trent, England

[73] Assignee: Acme Marls Limited, Stoke on Trent, England

[21] Appl. No.: 798,148

[22] Filed: May 18, 1977

[51] Int. Cl.[2] ..... F27D 5/00

[52] U.S. Cl. ..... 432/258

[58] Field of Search ..... 432/258, 259; 264/57, 264/58

[56] References Cited

U.S. PATENT DOCUMENTS 3,057,035 10/1962 Layne ..... 432/259

FOREIGN PATENT DOCUMENTS 534546 3/1941 United Kingdom ..... 432/258
538137 7/1941 United Kingdom ..... 432/258
664200 1/1952 United Kingdom ..... 432/259

*Primary Examiner*—Louis J. Casaregola
*Attorney, Agent, or Firm*—Parmelee, Miller, Welsh & Kratz

[57] ABSTRACT

A support structure for ceramic ware during firing in which very lightweight tubular props are used in combination with circular caps having projections which rest in the tops of the upright props. Each cap has a raised projection on the upper side which locates in a hole in a shelf. The shelves each have three such holes disposed in a triangular formation, each arranged midway between a respective edge of the shelf and a centerline parallel to the edge to reduce undesirable thermal effects during firing.

4 Claims, 6 Drawing Figures

SUPPORT STRUCTURE FOR CERAMIC WARE

BACKGROUND OF THE INVENTION

1. Field of the Invention

This invention relates to a support structure for ceramic ware to be fired in a kiln.

2. Description of the Prior Art

Usually, firing of ceramic ware is a lengthy process involving a fairly gradual build up of a high temperature and subsequent gradual cooling. Some articles, such as tiles, can be fast fired in a kiln for relatively short periods, of the order of one hour. The invention has been particularly devised for use in fast firing kilns.

Fast firing involves the raising of the temperature not only of the ceramic ware to be fired but also of the support structure which carries it, up to a firing temperature. If the thermal capacity of the support structure is too high, the amount of heat lost by absorption reduces the economic viability of the process and causes undue heating up delay which lengthens the firing cycle.

However, conventional supports for the ware tend to be unsuitable for fast firing kilns because the rapid heating and cooling causes severe thermal shock to the support structure.

It is essential that the strong expansion and contraction effects do not damage the support structure in use since otherwise the ware may be spoiled.

SUMMARY OF THE INVENTION

It is an object of the invention to provide a lightweight support structure for a kiln car which can withstand thermal shock experienced in a fast firing kiln.

According to the invention there is provided a support structure for ceramic ware adapted to be mounted on a kiln car and comprising a plurality of upright lightweight tubular props; a corresponding plurality of caps, one being disposed on top of each prop, each cap having a projection on its underside adapted to be received in the tubular end of the prop; and means for supporting ceramic ware associated with the caps.

Said means may comprise an upward projection on the upper surface of each cap. The projections may carry ware directly or may collectively support a horizontal shelf or bat.

Preferably, the bat is rectangular and has three circular holes to receive respective projections, the holes being disposed in a triangular formation and each being disposed approximately midway between a respective edge of the bat and a centreline parallel to said edge.

The bat may have a plurality of upstanding dimples on its upper surface to support the ware.

Alternatively, the means for supporting the ware may comprise one or more pins or pegs on each cap to contact the ware directly.

The props may be supported by hard refractory fittings cemented to secure them relative to the kiln car. Lateral movement of the base of the props may be prevented by a thick base bat having holes positioned so as to receive the bases of the props and having a snug clearance fit on the props.

DESCRIPTION OF THE DRAWINGS

The invention will now be described in more detail by way of example only with reference to the accompanying drawings in which.

The drawings are not all on the same scale.

DESCRIPTION OF PREFERRED EMBODIMENTS

Figure 1:
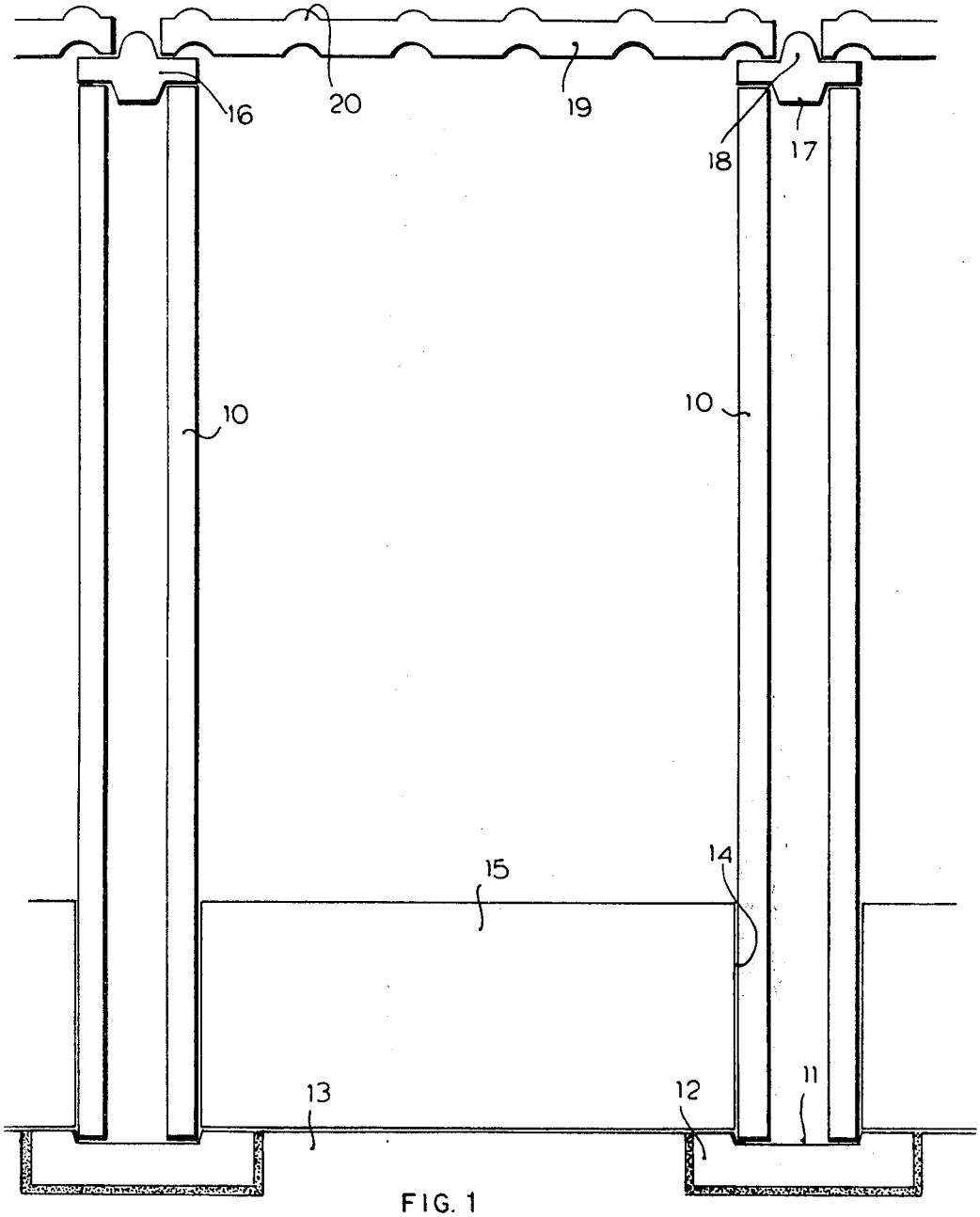
FIG. 1 is a side elevational view of a support structure according to the invention.
Figure 4:
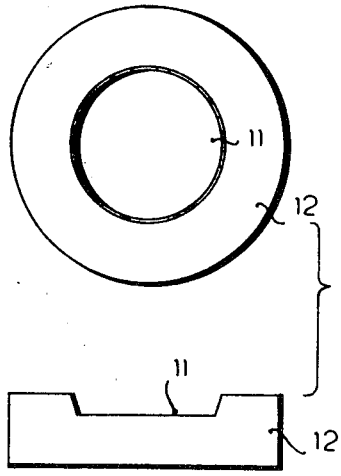
FIG. 4 is a plan view of a base fitting.

Referring firstly to FIG. 1 of the drawings, the support structure comprises thin walled ceramic tubes which form props 10. The lower ends of the props are received in hollows 11 of base supports 12. The base supports are as shown in FIG. 4 and are cemented or otherwise secured to the kiln car or to a thermal barrier disposed on the kiln car. In the embodiment shown, the thermal barrier is formed of insulation bricks 13 disposed around the base fittings 12. The barrier is necessary to prevent the intense heat of the kiln from affecting the kiln car running gear below the deck of the car.

The props 10 are inserted through spaced clearance holes 14 in a base bat 15 which has some insulating effect but is primarily used to locate the props against sidewards movement in any direction.

Figure 5:
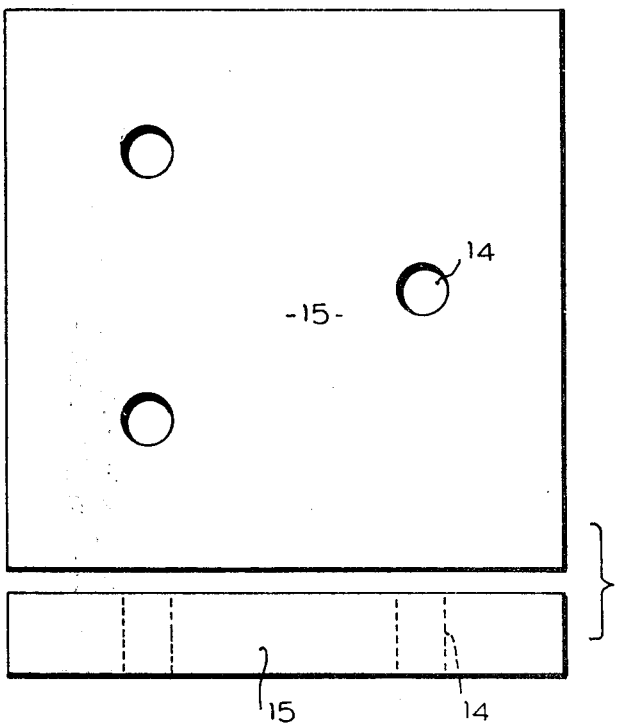
FIG. 5 is a plan view of a base bat.

The base bat 15 can be seen in FIG. 5, from which it will be seen that three holes 14 are provided. The positioning of the holes 14 can be determined very precisely in the manufacture of the base bat 15 and hence the exact position of the props can be predetermined. This enables the support structure to be loaded by machine rather than by hand if necessary, and guarantees that the top bat (when used) will always fit precisely onto the tubes.

The holes 14 are disposed at positions approximately midway between an edge of the base bat and the centreline parallel to the edge. The reason for this will later be referred to.

It will be seen that the holes 14 are deeper than their diameter in order to give good support to the props.

Figure 6:
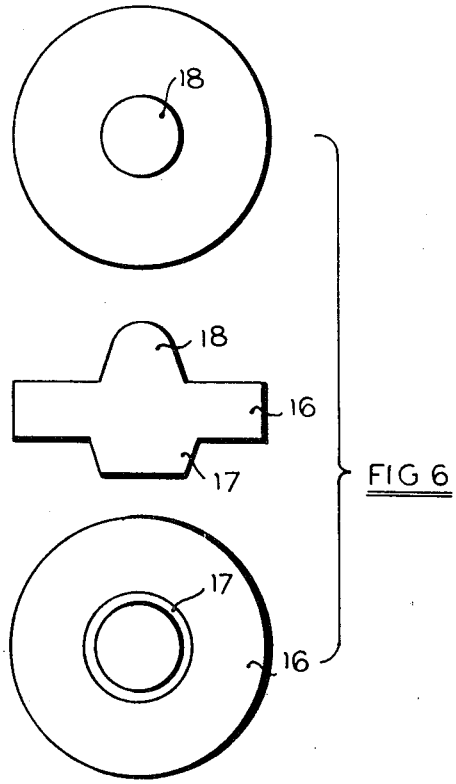
FIG. 6 comprises side elevation, plan and underneath plan views of a cap.

On top of each prop, there is a cap as shown in FIG. 6 which is not cemented in place but is a loose fitment. The cap 16 has a flange and a tubular projection 17 of downwardly tapering form provided on its underside. This formation is adapted to be inserted into the top of the prop 10 as seen in FIG. 1.

The upper side of the cap has a further upstanding projection 18 which is used to support ceramic ware either directly or indirectly.

The use of a separate cap means that, if any glaze dribbles from the articles being fired, this will build up only on the cap which may be easily replaced, instead of soiling a prop which would be a much more expensive item to replace. It is also much cheaper to make the prop as a separate tube since this can readily be extruded.

Figure 2:
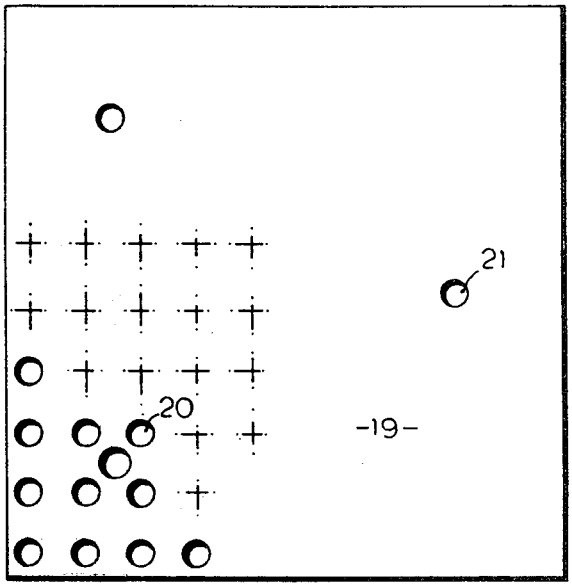
FIG. 2 is a plan view of a bat.
Figure 3:
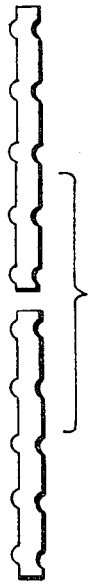
FIG. 3 is a sectional view taken on the line A—A of FIG. 1.

The props and caps may support the ware through a bat 19 which can be seen in FIGS. 1 and 2. The bat 19 is of thin ceramic material and has a plurality of upwardly projecting dimples 20. It also has three through holes 21 each of which is adapted to receive the upward projection 18 of a cap. This can most clearly be seen in FIG. 1.

The holes 21 are again spaced precisely at positions which are approximately midway between an associated edge of the bat and the centreline. The spacing corresponds to the spacing of the through holes 14 in the base bat 15.

The positioning of the holes is selected so that the holes are not close to the edges of the upper or base bats and are also not in a central position.

In our experience with fast firing kilns we have found that any prop which is used to support a bat tends to absorb heat and hold the heat so that a sharp temperature differential may exist in the region of the prop. We have found that this tends to cause cracking of the bat if the props are disposed at the edges, on the corners, or on the centreline of the bat and that, surprisingly, much of the risk of damage is removed by placing the props at positions midway between an edge and the parallel centreline of the bat. This applies equally to the bats supported by the prop and to the base bat.

It will further be noted that all the holes used in the bats are circular and of relatively small diameter. We have found that the use of non-circular holes also tends to result in cracking of the bat, the cracks propogating from any corners of the holes.

The top bat 19 may be used, for example for the once-firing of floor tiles which need full support but second firing of wall tiles does not generally require the use of a full support since the tiles are now self-supporting to some extent. Thus, the top bat can be removed for second firing of wall tiles and in other similar cases where no full support is required.

In this case, the ware is supported directly on the upstanding projections 18 of the caps 16.

Where the ware to be supported is glazed on both the upper and lower surfaces, the caps might mar the glaze and, for this type of application, a substitute cap is used which does not have the upstanding projection 18 but instead has a pin or peg which supports the ware. It will be appreciated that the ware is not supported from any kind of pins or pegs on the props but is supported only by the caps, in contrast with other previously proposed support structures.

I claim:

1. A support structure for supporting ceramic ware during firing, the structure comprising, in combination, a rectangular base having at least three circular holes therein, each hole being positioned mid-way between a respective edge of the base and a center line thereof parallel to said respective edge; a plurality of light-weight cylindrical tubular props equal in number to said circular holes and firmly located upright in respective ones of said holes in use, the base being of a thickness comparable to the diameter of said props; and a plurality of caps equal in number to said circular holes, each of said caps comprising a downward projection which loosely locates the cap on top of a respective one of said tubular props, and a small upward projection.

2. A support structure according to claim 1 and further comprising a rectangular shelf having substantially the same dimensions in plan as the base, the shelf also having a plurality of circular holes equal in number to, and disposed in the same relative positions as those of the base and being supported in use on said caps, the upward projections thereof locating in, but not extending entirely through, the holes of the shelf.

3. A support structure according to claim 1 wherein three circular holes only are provided in said base and are disposed at the apices of a triangle.

4. A support structure according to claim 2 wherein three circular holes only are provided in each of said base and said shelf and are disposed at the apices of respective triangles.

* * * * *

UNITED STATES PATENT OFFICE

CERTIFICATE OF CORRECTION

PATENT NO. : 4,141,681

DATED : Feb. 27, 1979

INVENTOR(S) : William J. Lovatt

It is certified that error appears in the above-identified patent and that said Letters Patent are hereby corrected as shown below:

After "[22] Filed: May 18, 1977" on page 1 of the patent, please insert the following priority data which was submitted to the Patent Office on June 13, 1977:

--[30] Foreign Application Priority Data

June 8, 1976 United Kingdom.....23548/76 --

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*